US005451056A

United States Patent [19]

Manning

[11] Patent Number: 5,451,056

[45] Date of Patent: Sep. 19, 1995

[54] METAL WOOD TYPE GOLF CLUB

[75] Inventor: George E. Manning, Prospect, Ky.

[73] Assignee: Hillerich and Bradsby Co., Inc., Jeffersonville, Ind.

[21] Appl. No.: 105,445

[22] Filed: Aug. 11, 1994

[51] Int. Cl.[6] ..... A63B 53/04

[52] U.S. Cl. ..... 273/167 F; 273/167 J

[58] Field of Search ..... 273/169, 167 H, 167 F, 273/172, 167 A, 167 G, 167 J, 167 K, 173–175

[56] References Cited

U.S. PATENT DOCUMENTS

| | | | |
|---|---|---|---|
| 1,526,438 | 2/1925 | Scott . | |
| 1,568,888 | 1/1926 | Dunn . | |
| 1,582,836 | 4/1926 | Link . | |
| 3,625,518 | 12/1971 | Solheim . | |
| 3,693,978 | 9/1972 | East | 273/167 F |
| 4,139,196 | 2/1979 | Riley . | |
| 4,214,754 | 7/1980 | Zebelean . | |
| 4,313,607 | 2/1982 | Thompson . | |
| 4,319,752 | 3/1982 | Thompson . | |
| 4,322,083 | 3/1982 | Imai | 273/167 F |
| 4,417,731 | 11/1983 | Yamada . | |
| 4,429,879 | 2/1984 | Schmidt . | |
| 4,432,549 | 2/1984 | Zebelean . | |
| 4,438,931 | 3/1984 | Motomiya . | |
| 4,444,392 | 4/1984 | Duclos . | |
| 4,461,481 | 7/1984 | Kim . | |
| 4,472,092 | 9/1984 | Schmidt . | |
| 4,502,687 | 3/1985 | Kochevar . | |
| 4,511,145 | 4/1985 | Schmidt . | |
| 4,602,787 | 7/1986 | Sugioka et al. . | |
| 4,618,149 | 10/1986 | Maxel . | |
| 4,681,321 | 7/1987 | Chen et al. . | |
| 4,697,813 | 10/1987 | Inoue . | |
| 4,754,969 | 7/1988 | Kobayashi | 273/167 H |
| 4,809,983 | 3/1989 | Langert . | |
| 4,811,949 | 3/1989 | Kobayashi . | |
| 4,842,243 | 6/1989 | Butler . | |
| 4,872,683 | 10/1989 | Doran et al. | 273/171 |
| 4,874,171 | 10/1989 | Ezaki et al. | 273/167 H |
| 4,944,515 | 7/1990 | Shearer . | |

(List continued on next page.)

FOREIGN PATENT DOCUMENTS

| | | |
|---|---|---|
| 153475 | 2/1951 | Austria . |
| 409233A | 1/1991 | European Pat. Off. . |
| 398643 | 3/1933 | United Kingdom . |
| 1476889 | 6/1977 | United Kingdom . |
| 2100993 | 1/1983 | United Kingdom . |
| 2225725 | 6/1990 | United Kingdom . |

OTHER PUBLICATIONS

"Ram Introduces Acculoar 78", Golf Digest, Dec. 1977, p. 101.

"Ultradyne III", Golf Digest, Mar. 1977, p. 72.

*Primary Examiner*—Vincent Millin

*Assistant Examiner*—Steven B. Wong

*Attorney, Agent, or Firm*—Welsh & Katz, Ltd.

[57] ABSTRACT

A metal wood type golf club head has a substantially hollow metallic body defining a bottom sole extending between a toe and heel, a top wall or crown, a ball striking face having parallel horizontal grooves, and a hosel formed at the heel to receive a shaft. The interior of the hollow body is filled with a foam material. The weight of the metallic body is distributed to establish an optimum impact point or sweet spot at substantially the geometric center of the ball striking face, and further establishes a plurality of substantially elliptical force lines on the face concentric with the sweet spot. Each elliptical force line represents a locus of points operative to impart substantially equal impact forces to a ball struck at a point on the corresponding elliptical force line, the major axis of the concentric elliptical force lines passing generally through the sweet spot substantially parallel to the grooves. Golf club heads in accordance with the present invention effectively provide larger sweet spots on the hitting faces of the heads so as to produce results from off-center shots that more closely approach the results produced when balls are struck at the sweet spot on the club head face.

8 Claims, 5 Drawing Sheets

U.S. PATENT DOCUMENTS 5,000,454 3/1991 Soda .
5,004,241 4/1991 Antonious .
5,028,049 7/1991 McKeighen ..... 273/167 H
5,042,806 8/1991 Helmstetter .
5,056,705 10/1991 Wakita et al. .
5,060,951 10/1991 Allen .
5,067,715 11/1991 Schmidt et al. .
5,094,383 3/1992 Anderson et al. .
5,131,986 7/1992 Harada et al. .
5,135,227 8/1992 Okumoto et al. .
5,141,230 8/1992 Antonious .
5,154,424 10/1992 Lo .
5,163,682 11/1992 Schmidt et al. .
5,172,913 12/1992 Bouquet .
5,213,329 5/1993 Okumoto et al. ..... 273/167 A
5,295,686 3/1994 Lundberg ..... 273/169
5,301,945 4/1994 Schmidt et al. ..... 273/167 A

METAL WOOD TYPE GOLF CLUB

BACKGROUND OF THE INVENTION

The present invention relates generally to metal wood type golf clubs, and more particularly to such golf clubs wherein the club head has a metallic shell and foam interior and has novel weight distribution providing substantially improved distance, accuracy and consistency over prior metal wood golf clubs.

The concept of metal wood type golf clubs having metallic shell-like or hollow heads is relatively old. See, for example U.S. Pat. No. 1,526,438 to Scott. More recent developments in metal wood type golf club designs have introduced a number of design changes which are alleged to provide improved accuracy, distance and shot consistency. Such developments have included distributing the weight of the metal head so as to enlarge the area of the striking face of the club head which can impact the ball without adversely affecting the flight path imparted to the ball. More particularly, the area of the ball-striking face of the club head about the "sweet spot" which can be impacted by the ball without significantly changing the flight characteristics of the resulting shot is increased. Ideally, the sweet spot, which is determined by the center of mass of the club head, alternatively termed the center of gravity, is located generally centrally on the ball-striking face of the club head. Conventionally, the ball-striking face is defined by a generally planar or somewhat convexly bulged surface having a predetermined loft angle and a plurality of parallel spaced grooves or score lines disposed generally horizontally when the club head is in a normal ball addressing orientation. During play, striking a golf ball off-center from the sweet spot generally adversely affects the distance, direction and spin imparted to the ball, thus affecting the consistency of results between similar shots or hits with a particular metal wood. Further, and a problem particularly encountered by golfers of lower skill level, the club head may rotate about an axis generally parallel to the axis of the club shaft at the moment of impact with a ball, due either to under or over rotation of the golfer's hands, or due to off-center striking of the ball. Such rotation of the club head further reduces the accuracy, distance, trajectory and consistency desired, frequently resulting in slicing or hooking of the ball.

SUMMARY OF THE INVENTION

A general object of the present invention is to provide a novel metal wood type golf club head which results in improved ball distance, accuracy and shot consistency.

A more particular object of the present invention is to provide a novel metal wood type golf club head wherein the head has a metallic shell defining a hollow interior filled with foam, and wherein the wall of the shell is made of a thickness to distribute the weight of the head so that a plurality of substantially elliptical imaginary or theoretical force lines are formed on the ball-striking face of head generally concentric with the centered sweet spot and with the major axis of the concentric elliptical force lines being parallel to horizontal grooves formed in the ball-striking face, the locus of points forming each given force line representing points at which substantially equal impact energy is imparted to a ball, notwithstanding that points on a particular elliptical force line may be spaced at different distances from the sweet spot.

Another object of the present invention is to provide a novel metal wood type golf club head as aforedescribed wherein the bottom sole has a concave recess formed at the rearward portion thereof enabling the head to be made of larger size with the weight of the head concentrated substantially adjacent the center of the ball-striking face of the club head, the recess also providing ground clearance for the rear portion of the head during ball impact.

Still another object of the present invention is to provide a novel relatively larger size metal wood type golf club head wherein the sole is formed with a relatively small radius uniform curvature from the toe to the heel of the head whereby to significantly reduce the chances of ground contact by the sole adjacent the toe or heel during ball impact.

A feature of the metal wood type golf club head in accordance with the present invention lies in providing a tubular hosel formed integral with the club head and having a first portion extending upwardly from the top wall or crown, and a second portion extending into the interior of the head and intersecting the sole adjacent the heel of the head.

In carrying out the present invention, a metal wood type golf club head is formed with a metallic shell or body having an internal cavity filled with foam. The head has a ball striking face having an upper margin formed integral with a top wall or crown and a lower margin formed integral with a leading edge of a bottom sole. The sole has a relatively small radius of curvature extending from the toe to the heel of the head. The sole also extends from its leading edge generally upwardly to intersect the rearward margin of the top wall and has a concave recess formed in its rearward portion which provides ground clearance and enables greater concentration of weight behind the center of the ball-striking face. The head is preferably made of stainless steel and has a wall thickness and resulting weight distribution so that a plurality of substantially elliptical theoretical force lines are formed in the ball-striking face concentric to the sweet spot and with the major axis of the concentric elliptical force lines being parallel to horizontal grooves formed in the ball-striking face. The locus of points forming each particular elliptical force line represent points at which substantially equal impact forces or energy are imparted to a ball struck by a point on the particular elliptical force line. A tubular hosel is formed integral with the head to facilitate connection to a shaft and has a first portion inclined upwardly from the top wall or crown and a second portion extending internally of the head at the heel and intersecting the sole. The club head lends itself to increased size over the traditional size wood type golf clubs, with an enlarged ball-striking face being more forgiving of shots hit off center from the sweet spot.

Further objects, features and advantages of the metal wood type golf club head in accordance with the present invention will become apparent from the following detailed description taken in conjunction with the accompanying drawings wherein like reference numerals designate like elements throughout the several views.

DETAILED DESCRIPTION

Figure 1:
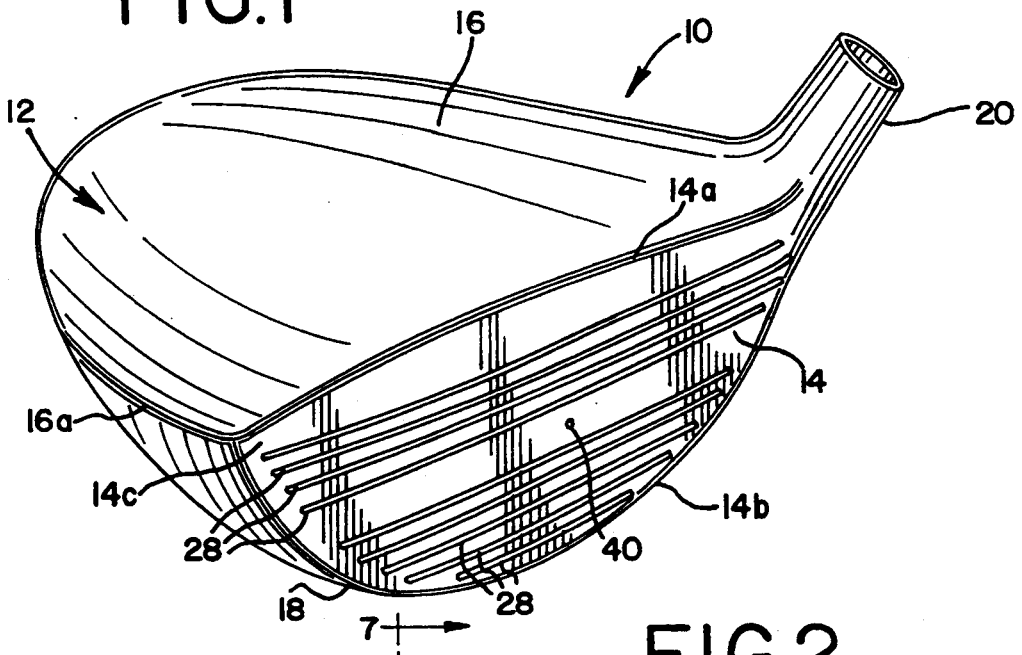
FIG. 1 is a perspective view of a metal wood type golf club head constructed in accordance with the present invention.
Figure 2:
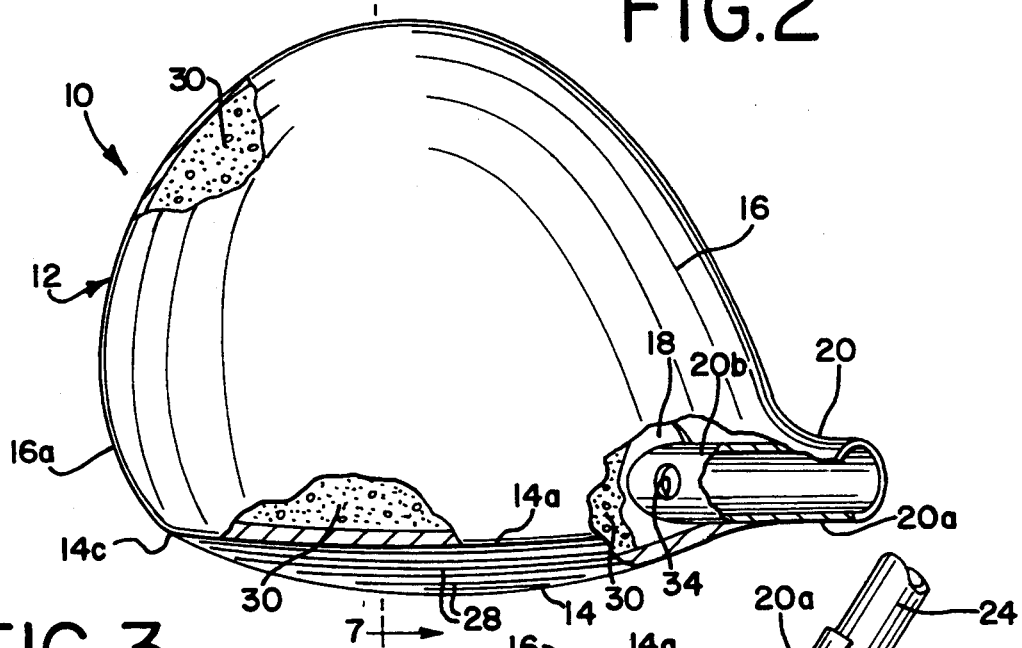
FIG. 2 is a plan view of the club head of FIG. 1 but with portions broken away for purposes of clarity.

Referring now to the drawings, a metal wood type golf club head constructed in accordance with the present invention is indicated generally at 10. Briefly, the metal wood type golf club head 10 includes a hollow metallic body 12 defining a ball-striking face 14, a top wall or crown 16, a bottom sole 18 and a generally tubular hosel 20. The club head body 12 is preferably formed as an integral metallic body from 17-4 precipitation hardness stainless steel which is preferably heat treated to approximately 37–38 Rockwell C so as to provide desired strength and toughness. The ball-striking face 14 has an upper marginal edge **14*a* formed integral with a forward or leading marginal edge surface of the upper wall or crown 16, and has a lower arcuate marginal edge 14*b* formed integral with a forward or leading edge of the sole 18. The sole has a convex outer surface that is formed with a relatively small radius of curvature extending from an upper toe edge 16*a* of the top wall or crown 16, termed the toe of the club head, to a heel end of the head defined by the intersection of the upwardly curved heel end of the sole with the marginal edge 16*a* of the upper wall 16 adjacent the hosel 20. As illustrated in FIG. 2, the upper wall or crown 16** has a generally "D" configuration when considered in plan view.

The hosel 20 is formed at the heel portion of the club head 10 and is adapted to receive the lower end **24*a* of a shaft 24 having a grip at its upper end to facilitate swinging of the club head 10 in a conventional manner. The shaft end 24*a* is suitably fixed within the tubular hosel 14** in a known manner through a suitable adhesive.

Figure 3:
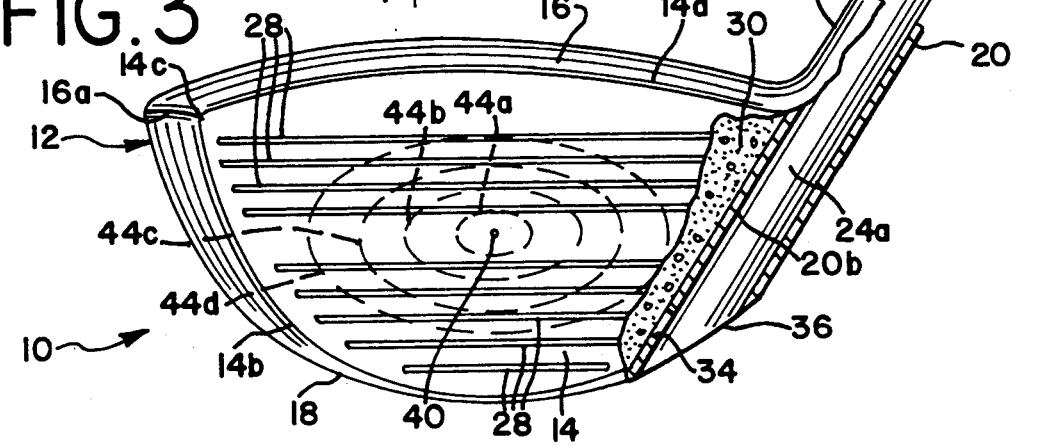
FIG. 3 is a front elevational view of the club head of FIG. 1 but with portions broken away for clarity.
Figure 4:
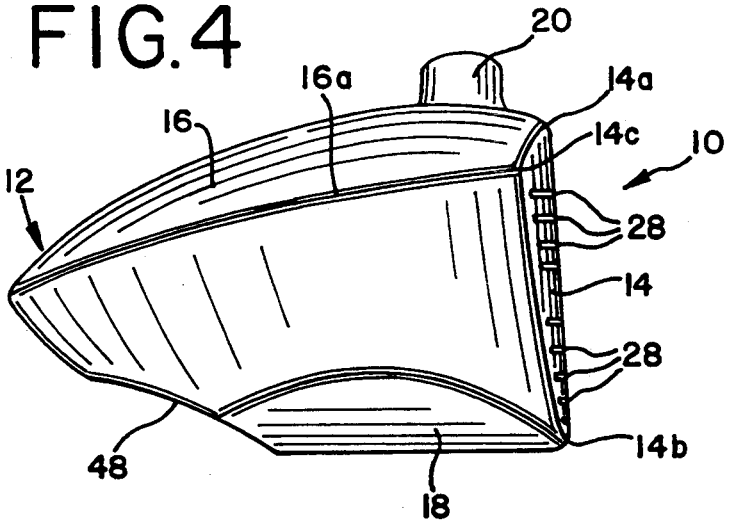
FIG. 4 is an elevational view of the toe end of the club head of FIG. 1.
Figure 5:
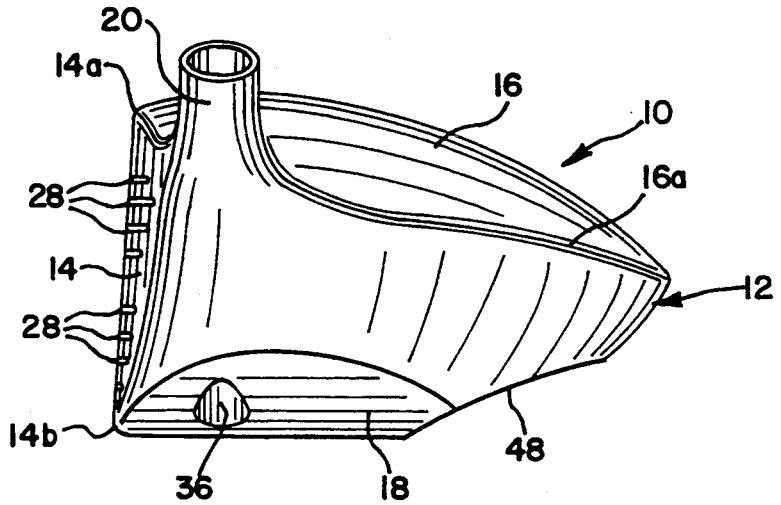
FIG. 5 is an elevational view of the heel end of the club head of FIG. 1.
Figure 6:
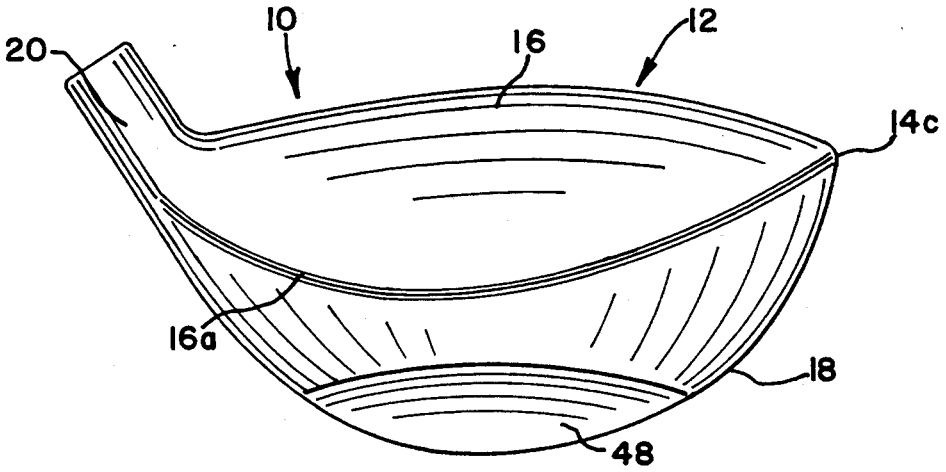
FIG. 6 is a rear side elevational view of the club head of FIG. 1.
Figure 8:
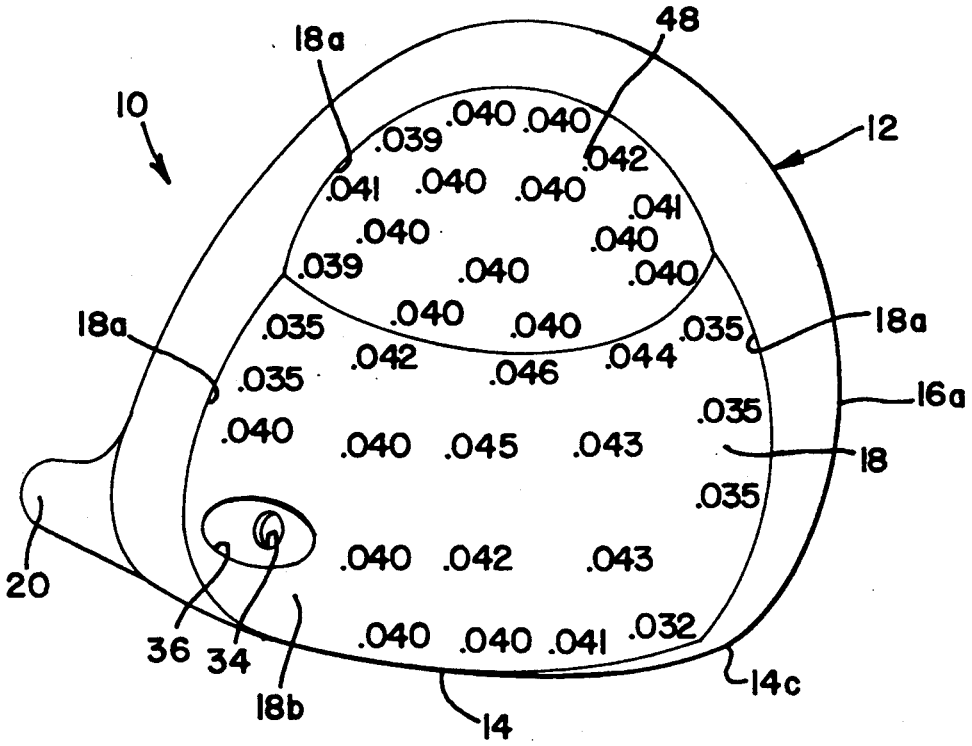
FIG. 8 is a bottom view showing the sole of the club head of FIG. 1 with wall thickness dimensions being indicated for various positions on the sole.
Figure 9:
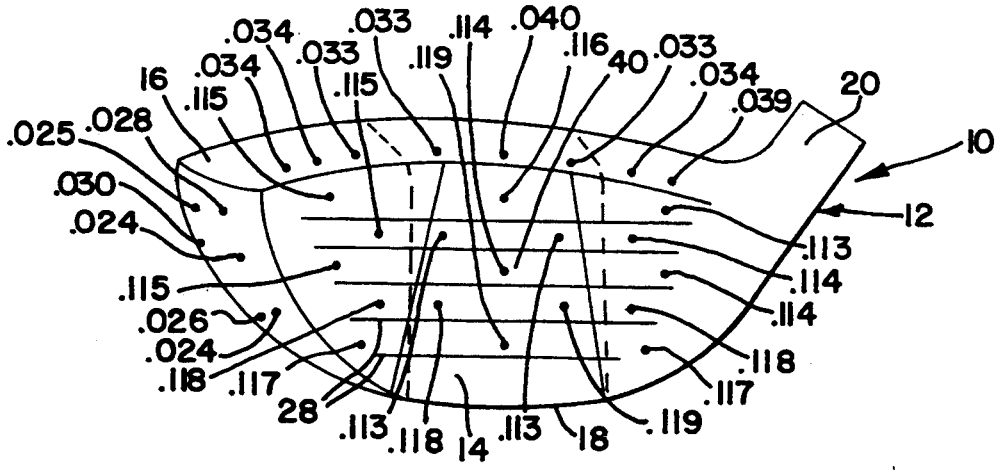
FIGS. 9–11 are front elevation, top plan and rear views, respectively, showing wall thickness dimensions for various locations on the club head of FIG. 1.
Figure 10:
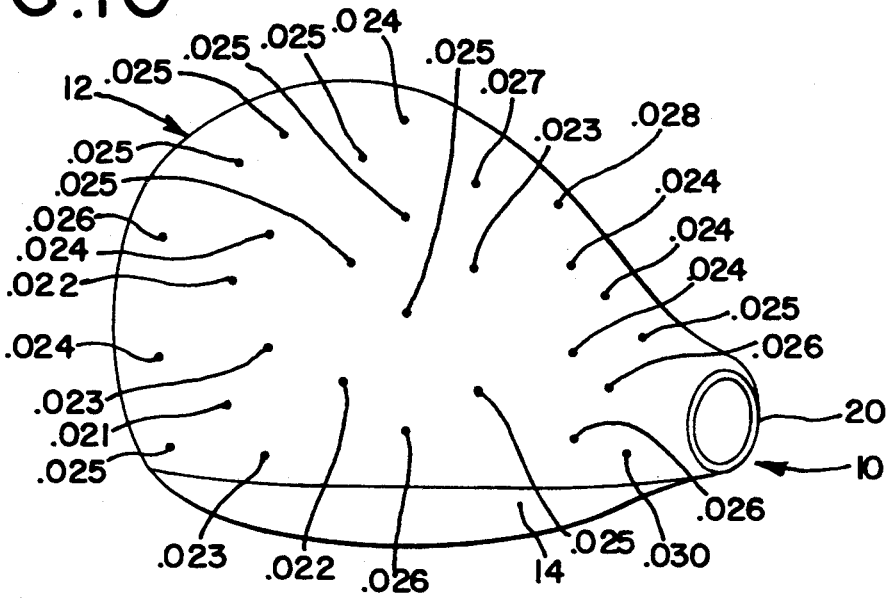
Figure 11:
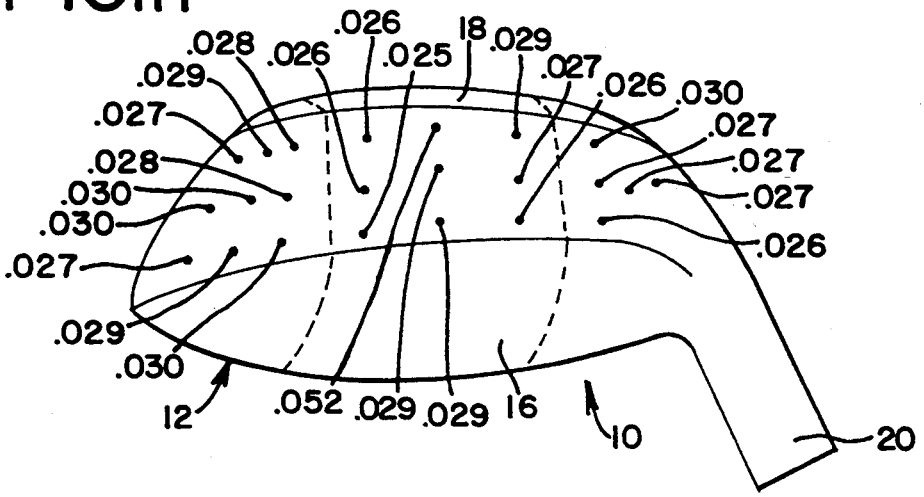

In the preferred method of making the club head 10, the ball-striking face 14, the top wall or crown 16, the hosel 20 and a portion of the sole 18 are formed as a casting having an open lower end or face defined by a marginal peripheral edge as indicated at **18*a* in FIG. 8. A stainless steel sole plate 18*b* is formed with an outer margin to mate with the edge surface 18*a*. The sole plate is welded at its peripheral edge to the marginal edge 18*a* of the opening to form the substantially closed hollow body 12. A plurality of parallel grooves or score lines 28 of approximately 0.030 inch width are formed in the ball-striking face 14 with land surface areas of approximately 0.090 inch width between adjacent grooves. The score lines or grooves are formed so as to be in substantially horizontal relation when the club head is in a ball addressing position, such as illustrated in FIG. 3. In the illustrated embodiment, a land area of approximately 0.260 inch vertical width is formed through the center of the ball-striking face 14. The grooves 28 extend substantially the full lateral width of the ball-striking face 14**. The size and geometry of the grooves or score lines are formed to meet standards set for golf club heads, and particularly wood type or metal wood type club heads.

The interior of the hollow body 12 is filled with a foam material 30 such as polyurethane. The foam is introduced into the interior of the body after affixing the sole plate **18*b* within the opening 18*a* in the sole. The foam may be injected into the hollow body through an opening 34 at the lower end of the hosel 20 internally of the hollow body. As illustrated in FIGS. 2 and 3, the hosel 20 includes an upper tubular portion 20*a* which is formed integral with the hollow body 12 and extends upwardly from the upper wall or crown 16 a distance of approximately ½ inch. The hosel 20 preferably has an outer diameter of approximately 0.455 inch and an internal diameter of approximately 0.345 inch. A 20° internal countersink is preferably formed at the upper end of the hosel to accommodate epoxy adhesive or the like when the shaft 24 is inserted into and fixed within the hosel. The hosel 20 includes a second tubular portion 20*b* which is formed integral with and internally of the hollow body 12. The tubular hosel portion 20*b* extends downwardly to intersect the lower sole 18 and form an opening 36 in the sole 18 at the lower end of the hosel. The opening 36 facilitates introduction of foam into the interior of the hollow body through the opening 34 prior to assembling a shaft 24 into the hosel. The shaft 24** is preferably a high impact shaft such as designated model EI-90 commercially available from Hillerich and Bradsby Co., Inc. Jeffersonville, Ind. Alternatively, a model S-300 shaft may also be used.

As will become apparent, a feature of the golf head 10 in accordance with the invention is that it may be made of a size larger than conventional wooden type golf clubs so as to present a ball striking face 14 which has a larger surface area than provided on traditional size wood golf clubs. To this end, a metal wood type club head in accordance with the present invention having a loft angle of approximately 7.5° preferably has a sole radius of curvature extending from the toe to the heel, as considered FIG. 3, in the range of approximately 2.5–3 inches. The ball-striking face 14 preferably has a face height, from its lowermost leading edge **14*b* to the uppermost point on its upper marginal edge 14*a*, of approximately 1.640 inches. The face 14 has face length, as considered from the toe point 14*c* to a heel end 15*d* adjacent the hosel 20, of approximately 3,625 inches. With this size ball striking face, the club head 10 was formed with a dimension of approximately 4.30 inches from the extreme toe point of the upper wall 16 to the outermost surface of the hosel 20 at the top wall. The horizontal width of the club head 10, as considered from the leading edge of the ball-striking face 14 to the trailing edge of the top wall 16, was made to a dimension of approximately 3.35 inches. The vertical distance from the uppermost surface of the top wall or crown 16 to the lowermost leading edge of the ball striking face 14 is approximately 1.85 inches. The ball-striking face 14** is preferably formed with a bulge radius, considered in a substantially horizontal plane, of approximately 11 inches, and a roll radius, considered in a vertical plane, of approximately 11 inches. The metallic body 12 is also formed with a face progression, considered as the distance between a vertical plane tangent to the lower leading edge of the ball striking face 14 and a parallel vertical plane containing the axis of the hosel 20, in the range of approximately 0.625 inch for a 7.5° loft metal wood to approximately 0.812 inches for a metal wood formed with a face loft angle of approximately 21°.

In accordance with one feature of the invention, the thicknesses of the ball-striking face 14, the top wall 16 and the sole 18, coupled with the mass weight of the hosel 20, the weight of the foam 30, and the configuration of the body 12, are selected to establish an optimum impact point or sweet spot substantially at the geometrical center of the ball striking face 14, as represented by the dot 40 in FIG. 3. The distribution of the weight of the hollow body 12, as considered through the ball striking face 14, upper wall 16 and sole 18 is selected to establish a plurality of substantially elliptical theoretical force lines on the ball striking face 14 such as indicated by the concentric elliptical shaped dash lines 44*a–d* in FIG. 3. The elliptical force lines are concentric with the central optimal impact point or sweet spot 40, with the major axis of the elliptical force lines passing through the sweet spot and being parallel to the grooves or score lines 28.

Each of the theoretical elliptical force lines 44*a–d* represents a locus of points on the ball-striking face 14 which are operative to effect a generally equal impact force to a ball struck by the face substantially on a given elliptical force line. For example, a ball impacted by a point on the theoretical elliptical force line 44*b* will have substantially the same impact force or energy imparted to the ball irrespective of the point on the line 44*b* which impacts the ball. Similarly, a ball impacted generally at a point on the elliptical force line 44*c* will have an impact force or energy imparted to the ball equal to the impact force or energy imparted to the ball when struck by any other point on the elliptical force line 44*c*. Each of the elliptical force lines 44*a* and 44*d* will similarly cause a ball struck by a point on the respective elliptical force lines to have an equal force or energy imparted thereto irrespective of the position on the elliptical line which the ball impacts. With the major axis of the elliptical force lines being parallel to the horizontal grooves 28, it will be appreciated that the club head 10 may impact a ball a greater distance off-center from the sweet spot 40 in the horizontal direction of the ball-striking face without adversely affecting the distance or flight path imparted to the ball, as compared to conventional or prior wood golf clubs or metal wood golf clubs. Thus, the club head 10 is more forgiving of the consequences which normally result from hitting a ball significantly off-center from the sweet spot of a wood golf club head.

In accordance with the present invention, such theoretical substantially elliptical concentric force lines are created on the ball-striking face 14 of the club head 10 by selective distribution of the weight of the club head. Such distribution of weight is effected by the thickness of the face 14, the top wall 16 and the sole 18, including the sole plate 18*b*, of the club head body 12, taking into consideration the weight of the hosel 20 and the weight of foam 30 internally of the hollow body. FIGS. 8–11 illustrate wall thickness mapping for the ball-striking face 14, the top wall 16 and the sole 18 by indicating wall thickness at various locations throughout these areas of the club head. It is seen that the thickness of the hollow body 12 ranges from approximately 0.020 inch to approximately 120 inch with the major thickness and thus unit weight, being provided in the face 14.

Figure 7:
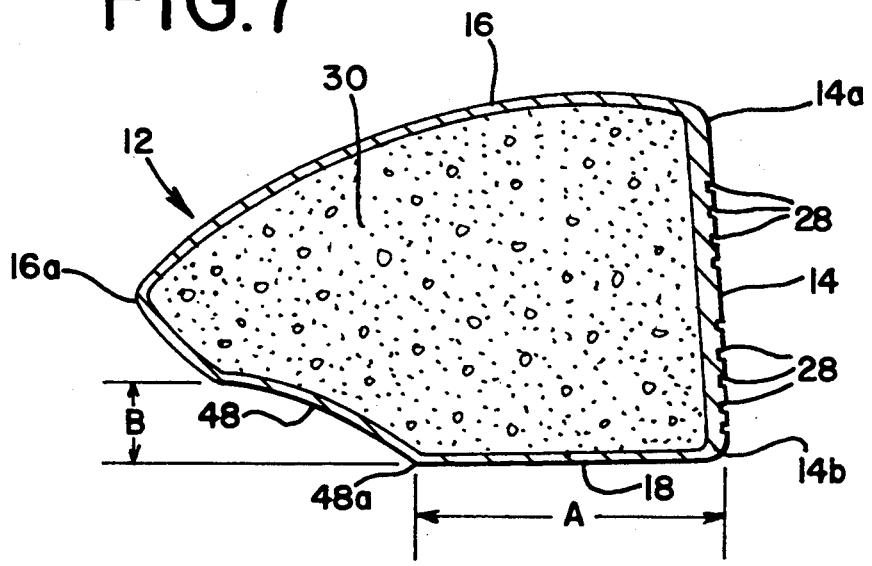
FIG. 7 is a transverse sectional view taken substantially along line 7—7 of FIG. 2.

With the thickness of face 14, top wall 16 and sole 18 being as indicated in FIGS. 8–11, the body 12 is further configured to place the center of gravity of the body 12 and the foam 28 inserted within the body so as to lie substantially behind the geometrical center or sweet spot 40 in the face 14 of the club head. To this end, the pole 18 has a concave recess 48 formed in its rearward portion as illustrated in FIGS. 4–8. Referring particularly to FIG. 7, the concave recess 48 is formed with a radius of curvature of approximately 2 inches, as considered in the plane of FIG. 7, with the forward marginal edge 48*a* of the concave surface intersecting the arcuately shaped sole surface 18 at a point approximately 1.625 inches rearwardly from the leading edge 14*b*, as represented by the dimension "A" in FIG. 7. The concave surface 48 is positioned so that its trailing edge intersects the upwardly sloping rearward portion of the sole 18 at 48*b*, with the vertical distance between the forward and rearward marginal edges of the concave surface 48 being approximately 0.5" as represented by dimension "B" in FIG. 7. By forming the concave surface 48 as described, and with the foam 30 inserted into the hollow body 12 to obtain the overall desired weight of the club head, the center of gravity of the club head will lie substantially rearwardly of the sweet spot 40 and the aforedescribed theoretical elliptical force lines will be formed in the face 14 of the club head. The convex curvature of the sole 18, as considered in the front elevational view of FIG. 3, has its apex lying substantially beneath the center of gravity of the club head 10 when in its ball addressing position.

Figure 12:
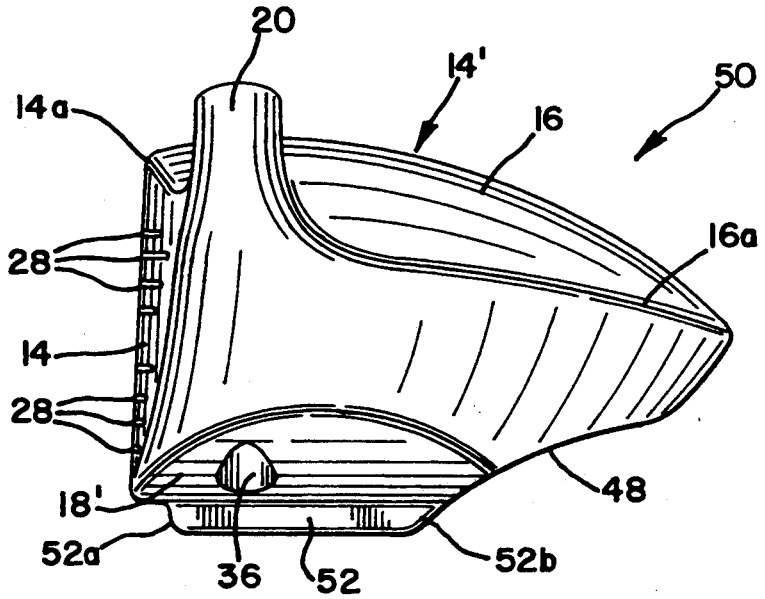
FIG. 12 is an elevational view of the heel end of a metal wood type golf club head in accordance with an alternative embodiment of the present invention.
Figure 13:
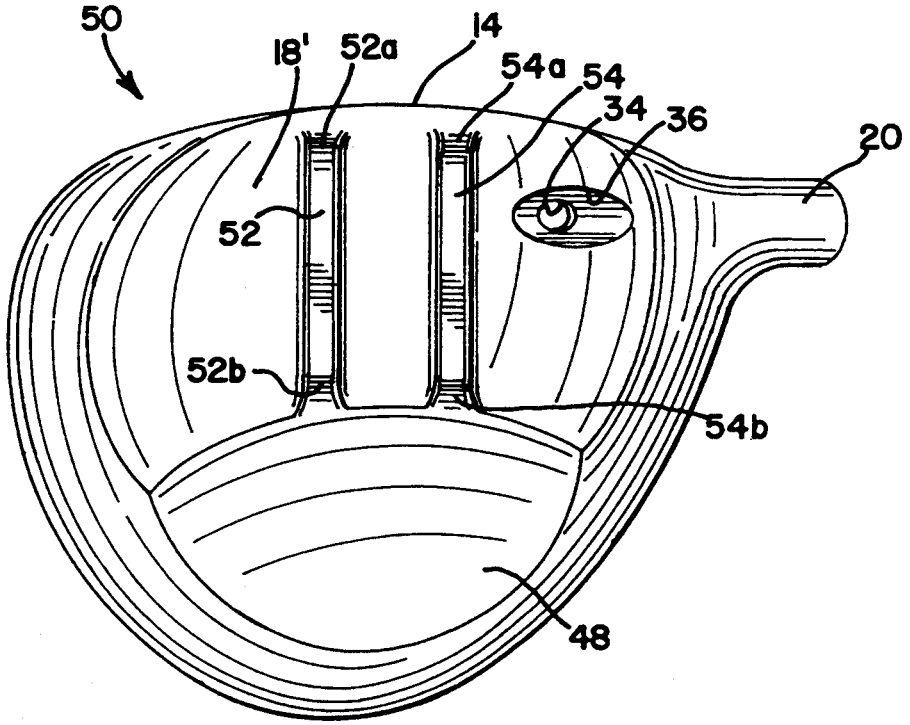
FIG. 13 is a bottom view of the club head of FIG. 12.

FIGS. 12 and 13 illustrate an alternative embodiment of a metal wood type golf club head, indicated generally at 50, in accordance with the present invention. The elements or portions of the club head 50 which are substantially identical to the corresponding elements of the club head 10 are represented by corresponding reference numerals. The metal wood type club head 50 finds particular application as a No. 3 and/or No. 5 type wood having a loft angle in the range of approximately 15°–21°. The club head 50 has a pair of rails 52 and 54 formed integral with a lower sole surface 18' which has a relatively small radius of curvature from the toe to the heel of the club head 50 similar to the sole 18 on the club head 10. The rails 52 and 54 extend in parallel spaced relation substantially perpendicular to a plane tangent to the leading edge of the ball-striking face 14 at substantially equal distances on either side of a vertical plane normal to the ball-striking face and containing the sweet spot 14. In one embodiment, the rails 52 and 54 were spaced apart approximately 0.300 inch.

Each of the equal size rails 52 and 54 has a leading edge 52*a* and 54*a*, respectively, which is spaced rearwardly from the leading edge of the face 14 as illustrated in FIG. 12. Each of the rails has a trailing edge 52*b* and 54*b* which terminates at the intersection of the arcuate surface 48 with the lower portion of the sole 18'. The rails 52 and 54 extend downwardly from the sole 18' so as to provide low friction ground engaging rails in the event the club head engages the ground during impacting of a ball. In other respects, the club head 50 is substantially similar to the club head 10 in that the weight distribution, as established by the wall thickness throughout the hollow body 14' and the configuration of the arcuate surface 48 are such as to establish similar theoretical elliptical concentric force lines on the face 14 of the club head 50, with the major axis of the concentric elliptical force lines passing through the center or sweet spot of the face parallel to the horizontal grooves 28 formed in the face. Similarly, each of such elliptical force lines defines a locus of points which impart substantially equal impact force or energy to a ball struck by a point on a particular elliptical force line. In this manner, the club head 50 similarly substantially improves the distance, accuracy and consistency of shots made with the club head.

Thus, in accordance with the present invention a metal wood type club head is provided which has greater forgiveness for off-center shots by providing greater distance, accuracy and consistency over prior metal wood type golf clubs, particularly those having generally increased size over conventional size wood clubs with the ball-striking face presenting substantially greater area for impacting the ball. The relatively small radius from toe to heel of the sole of the club heads 10 and 50 substantially reduces ground contact of the toe or heel portions of the club during play. The concave recess 48 in the rearward portion of the sole, in addition to facilitating distribution of the weight of the club head substantially immediately behind the geometrically center of the ball-striking face, also provides ground clearance during swinging of the club head. By reducing the possibility of ground engagement by the club heads 10 and 50, the likelihood of inadvertent and undesirable rotation of the club head due to ground contact is substantially reduced.

While preferred embodiments of metal wood type golf clubs in accordance with the present invention have been illustrated and described, it will be understood that changes and modifications may be made therein without departing from the invention in its broader aspects. Various features of the invention are defined in the following claims.

What is claimed is:

1. A metal wood type golf club head comprising a substantially hollow metallic body defining a toe portion, a heel portion, a bottom sole extending between said toe and heel portions and having a rearward marginal edge and a forward marginal edge, a top wall extending between said toe and heel portions and intersecting said rearward marginal edge of said sole and an upper marginal edge of a ball striking face extending from said toe portion to said heel portion, said ball striking face intersecting said forward marginal edge of said sole, a hosel formed at said heel portion and adapted to receive an end of a swing shaft in connected relation to said head, and a foam material substantially filling the interior of said hollow body, said ball striking face having a plurality of parallel grooves formed therein which are disposed in a horizontal orientation when the club head is in a ball addressing position, said ball striking face, said top wall and said sole having internal surfaces free of inwardly directed projections and having thickness which, coupled with the mass weight of said hosel, the weight of said foam and the configuration of said body, establish an optimum impact point at substantially the geometric center of said ball striking face and further establish a plurality of substantially elliptical theoretical force lines on said face generally concentric with said central impact point, each of said elliptical force lines representing a locus of points on said striking face operative to effect a generally equal impact force to a ball struck by the face substantially on a given elliptical force line, the major axis of the concentric elliptical force lines passing substantially through the optimum impact point on said striking face substantially parallel to said grooves.

2. A golf club head as defined in claim 1 wherein said bottom sole has a concave recess formed in the rear portion thereof spaced from its forward marginal edge so as to raise the center of gravity of the head.

3. A golf club head as defined in claim 1 wherein said sole has a convex surface extending from said toe to heel portions and defined by a relatively small radius of curvature having an apex substantially beneath the center of gravity of said head when in a ball-addressing position.

4. A golf club head as defined in claim 1 wherein said hosel is formed integral with said head at the heel portion, said hosel being defined by a tubular member having a first portion extending upwardly from the top wall of said head and a second portion extending into the interior of said head and intersecting said sole such that a swing shaft may extend internally of the tubular member substantially the full length thereof.

5. A golf club head as defined in claim 1 wherein said head is formed to weigh in the range of approximately 180 grams to 192 grams without said foam internally thereof.

6. A golf club head as defined in claim 1 including at least two parallel spaced rails fixed to the bottom of said sole, said rails extending in a direction generally perpendicular to said ball-striking face and defining ground engaging rail surfaces disposed below the lowermost surface of said sole when the club head is in a ball-addressing position.

7. A golf club head as defined in claim 6 wherein said rails are formed integral with said sole.

8. A golf club head as defined in claim 1 wherein said head is formed of stainless steel, said foam comprising polyurethane.

* * * * *